United States Patent [19]

Goldner

[11] Patent Number: 4,813,644

[45] Date of Patent: Mar. 21, 1989

[54] TELESCOPING MUSIC STAND

[76] Inventor: Richard Goldner, 1A Campbell Street, Balmain, New South Wales, Australia

[21] Appl. No.: 164,126

[22] Filed: Mar. 4, 1988

[51] Int. Cl.[4] ..... A47B 19/00

[52] U.S. Cl. ..... 248/441.1; 248/188.5; 248/188.6; 248/461; 248/464

[58] Field of Search ..... 248/441.1, 446, 448, 248/449, 460, 461, 463, 464, 171, 188.5, 188.6

[56] References Cited

U.S. PATENT DOCUMENTS

| | | | |
|---|---|---|---|
| 368,426 | 8/1887 | Ruttman et al. | 248/188.5 |
| 765,187 | 7/1904 | Meyer et al. | 248/461 |
| 987,547 | 3/1911 | Caputi | 248/461 |
| 987,884 | 3/1911 | Jellison | 248/461 |
| 1,069,617 | 8/1913 | Ilvonen | 248/461 |
| 1,675,621 | 7/1928 | Spencer | 248/448 |
| 1,900,251 | 3/1933 | Moore | 248/463 |
| 4,121,799 | 10/1978 | Michio | 248/171 |
| 4,215,839 | 8/1980 | Gibran | 248/188.6 X |
| 4,355,779 | 10/1982 | Heled | 248/460 |
| 4,606,525 | 8/1986 | Lombardi | 248/460 |

*Primary Examiner*—Ramon O. Ramirez
*Attorney, Agent, or Firm*—Hughes, Cassidy & Multer

[57] ABSTRACT

A folding support stand especially adapted to be collapsed into a compact unit for storage or transport. The support stand comprises one or more main support members which interfit in slideable telescopic relationship with one another. Positioned circumjacent the main support members is a brace support structure which comprises an upper tubular brace section having a cross-sectional configuration corresponding to that of the main support members, and a plurality of bracing struts hingedly affixed to the upper tubular brace section. A leg support structure is positioned circumjacent the brace support structure and comprises an upper tubular leg section having a cross-sectional configuration corresponding to that of the main support member and the brace support structure, and a plurality of leg members hingedly affixed to the upper tubular leg section. The lower ends of the bracing struts and the leg members are affixed to one another, so that when the upper tubular leg section is moved upwardly about the upper tubular brace section an upper portion of the leg members moves upwardly causing the leg members and bracing struts to move radially outwardly to a supporting position. A collar member is provided to maintain the leg members and bracing struts in the closed position, the collar member being an actuating member to move the upper tubular leg section upwardly to the open position.

38 Claims, 7 Drawing Sheets

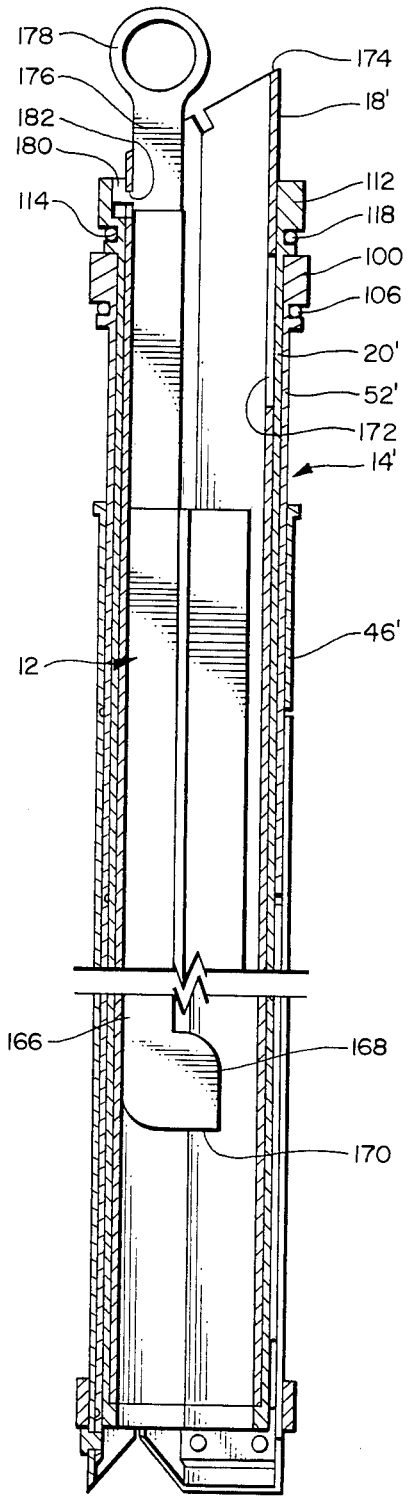
FIG. 7
FIG. 8
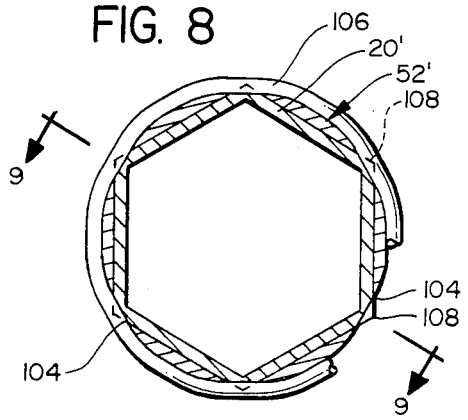
FIG. 9
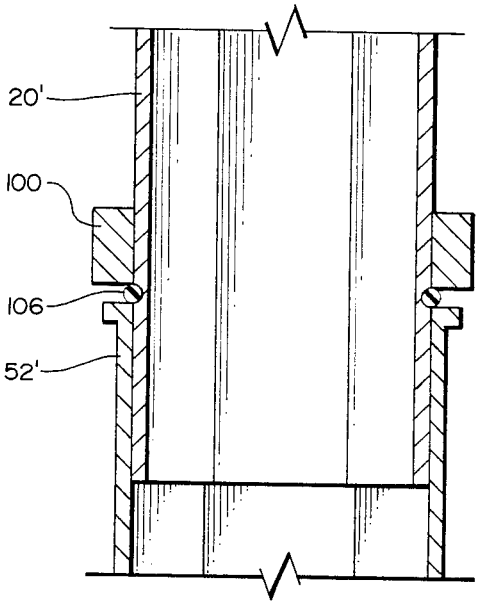

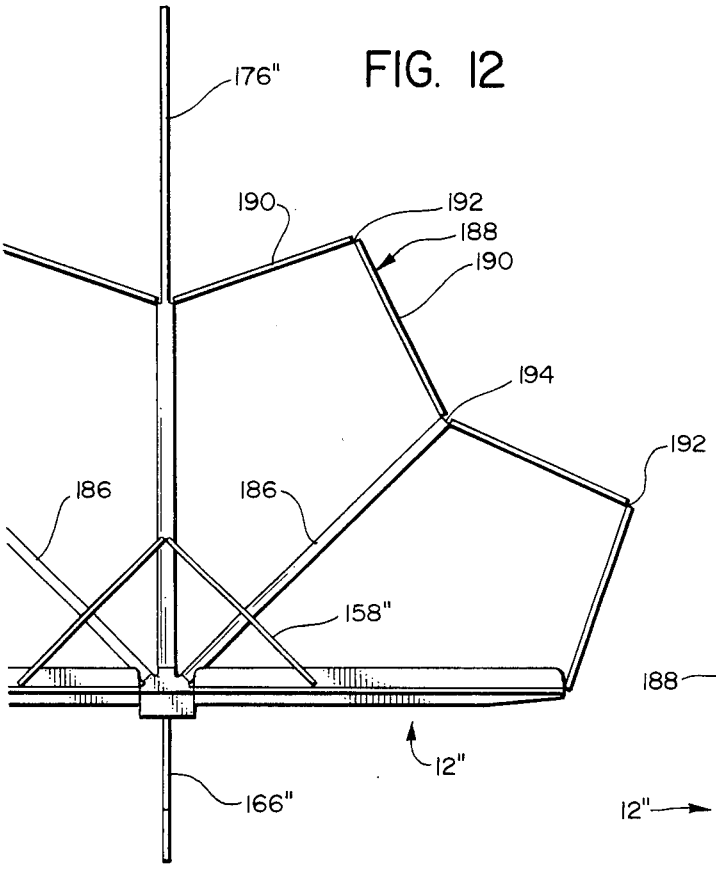
FIG. 12
FIG. 13
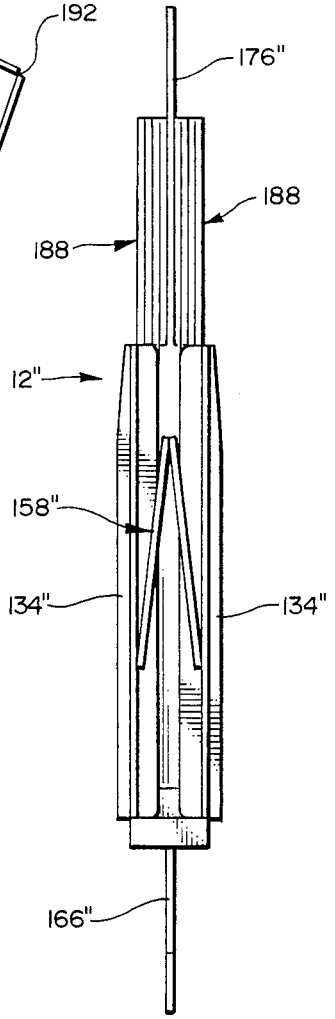

TELESCOPING MUSIC STAND

BACKGROUND OF THE INVENTION

The present invention relates to folding music stands, such as those which may be folded into a compact unit for convenient storage or transport.

One of the problem areas in providing music stands which may be folded into a compact unit is that the supporting structure is typically less stable than a music stand which is totally rigid due to the construction of the folding leg structure.

One type of prior art music stand, as shown in U.S. Pat. No. 765,187, Meyer et al, shows a plurality of legs which are hingedly mounted to a collar member. The invention contemplates using four legs, each of which are triangular in shape, such that when folded to the position of FIGS. 1 and 5, the legs form an outer rectangular structure enclosing the telescoping tubular sections. The legs are provided with links which fold together between the legs in the folded position. The music rack folds within the upper telescopic section and the collar member moves upwardly about the telescoped sections to force the legs into the folded tubular position.

U.S. Pat. No. 478,460, Potter, illustrates a folding music stand wherein the legs are pivoted in slots formed in a disc which slides in the lower portion of a tubular support member. The legs are spring mounted so that when a collar member is removed from the legs in the closed position, they will automatically extend to an open position. In a closed position, the legs and support members affixed thereto are carried in a slotted portion of the tubular support member. A folding music rack may be folded and inserted within the tubular support member.

U.S. Pat. No. 1,364,169, Wolf, illustrates yet another folding music stand configuration wherein a telescoping rod is carried within a tubular casing, the rod having a slideable collar and spring attached thereto. Three legs are hingedly mounted to the rod such that when the telescoping rod is extended beneath the casing, the legs are biased outwardly by the pressure of the spring.

U.S. Pat. No. 987,547, Caputo, illustrates yet another folding music stand configuration wherein three legs may be pivoted upwardly about a telescoping support section, and a music rack may be removed from an upper end support sections and affixed to the support section so as to enclose the upwardly folded legs.

While not considered relevant herein, U.S. Pat. Nos. 368,426, Ruttman et al, 829,411, Marcy, and 2,545,699, Johannson, where releaved in a search of patent office files and are noted herein in the interest of full disclosure.

SUMMARY OF THE INVENTION

In the present invention, there are one or more elongate main support members having uniform cross-sectional configurations adapted to slideably interfit in telescopic relationship with one another. Each of the main support members comprises a plurality of first flat side portions and a plurality of first intermediate side portions positioned between the flat portions and connecting the flat portions to one another. A brace support structure is positioned circumjacent the main support members and comprises an upper tubular brace section having a cross-sectional configuration corresponding to that of the main support member and comprises second flat side portions and second intermediate side portions. Hingedly affixed to the upper tubular brace section are a plurality of bracing struts, each of the struts comprises a web portion shaped as a downward extension of a related second flat side portion and a pair of lateral flange portions shaped as downward extensions of lateral portions of related second bracing intermediate side portions. Positioned circumjacent the brace support structure is a leg support structure which comprises an upper tubular leg section having a cross-sectional configuration corresponding to that of the brace support structure and having third flat side portions and third intermediate side portions. The lower ends of the bracing struts are connected to the lower ends of corresponding leg members. The lateral flange portions of the bracing struts and leg members are arranged at a 120° angle to the web portions, and the first intermediate side portions are arranged at a 120° angle to the first flat side portions of the main support members. There are three bracing struts and three leg members hingedly affixed to the upper tubular brace section and the upper tubular leg section, respectively.

The upper tubular leg section overfits the upper tubular brace section in telescoping relationship, so that when moving the apparatus from the closed position to the open position, the upper tubular leg section is moved upwardly about the upper tubular brace section the upper portion of each of the leg members moving upwardly relative to the upper portion of each of the corresponding bracing struts. Therefore, the leg members and bracing struts are moved radially outwardly into their tripodal supporting position. A retaining collar member is provided with overfits and maintains the leg positions in the closed position, and which functions as an actuating member when moving the upper tubular leg section upwardly about the upper tubular brace section.

In a further embodiment of the present invention, the upper tubular brace section is mounted in telescoping relationship with the main support member, and each of the main support member and the upper tubular brace section has at least one edge corner portion. The edge corner portion of the upper tubular brace section has a through opening. There is a retaining ring member extending around the upper tubular brace section and positioned in the through opening so as to engage the edge corner portion of the main support member to yieldingly resist relative telescoping motion between the upper tubular brace section and the main support member.

In the preferred form, the edge corner portion of the main support member has a recess to receive the retaining ring member, with the retaining ring member yieldingly resisting movement in and out of said recess. Desirably, the upper tubular brace section has a plurality of edge portions, each having a related through opening to receive the retaining ring member, and the main support member has a plurality of said recesses to receive in yielding engagement the retaining ring member. The retaining ring member can be made of an elastomeric material which yieldingly engages the recesses.

Also in this other embodiment, the main support member comprises inner and outer main support sections mounted in telescoping relationship relative to one another, and these are formed with similar openings and recesses to receive a retaining ring member.

Also, in the further embodiment, there is a support platform adapted to be mounted to the main support member. This platform comprises a base portion comprising first and second base sections pivotally mounted at a lower middle pivot location for movement between an expanded support position where the sections extend laterally outwardly from one another, and a stowed position where the base sections extend upwardly adjacent one another. There is also an upstanding back support portion comprising a plurality of support sections extending radially outwardly from the pivot location. In one version, each of these support sections has inner end portions movable toward and away from one another and connecting to inner end portions of adjacent support sections. Each of these support sections has outer end portions which connect to one another. The inner end portions interconnect with the base sections in a manner that when the base sections are moved to the expanded support position, the inner ends of the support sections move away from one another to an expanded support position, and when the base sections are moved toward one another, the inner portions of these support sections move toward one another to a stowed position.

Also, in a preferred configuration of the support platform, each of the first and second base sections has a lengthwise extending flange portion extending radially outwardly from the pivot location, and each flange portion is pivotally mounted to its related base section about a lengthwise pivot axis so as to be movable away from its related base section to an expanded position. The flange portions are interconnected by a bracing linkage which is movable with said flange portions to a retaining position to hold the base section in the expanded support position.

Also, the support portion of the platform has at an upper end thereof carrying ring means. The platform is characterized in that in the stowed position, the platform can be inserted within the main support member and said support stand apparatus can be carried by the ring means.

Also, in the preferred form, the platform has a mounting member extending downwardly from the base portion and configured to be inserted in an upper end of the main support member. The mounting member has interconnecting means by which the mounting member can be connected to the main support member in a manner that the platform can be mounted to the main support member in its expanded support position.

A further feature is that in the preferred form the mounting member and the bracing flange are arranged to interengage one another in the retaining position of the bracing linkage to hold the base sections in their expanded position.

Other features will become apparent from the following detailed description.

BRIEF DESCRIPTION OF THE DRAWINGS

FIG. 7 is a vertical sectional view showing the music sheet rack member positioned within the upper end of the telescoping member, and with the entire stand in its stowed or collapsed position;

FIG. 8 is a sectional view taken in horizontal seciton along line 8—8 of FIG. 6;

FIG. 9 is a vertical sectional view taken along line 9—9 of FIG. 8, showing the retaining ring holding the telescoping member in its extended position;

FIG. 12 is a view similar to FIG. 10 of a modified version of the music sheet rack member of the second embodiment; and FIG. 13 is a view similar to FIG. 11, showing the modified version of the music sheet rack member of FIG. 12 in the collapsed position.

DETAILED DESCRIPTION OF THE PREFERRED EMBODIMENT

Figure 1:
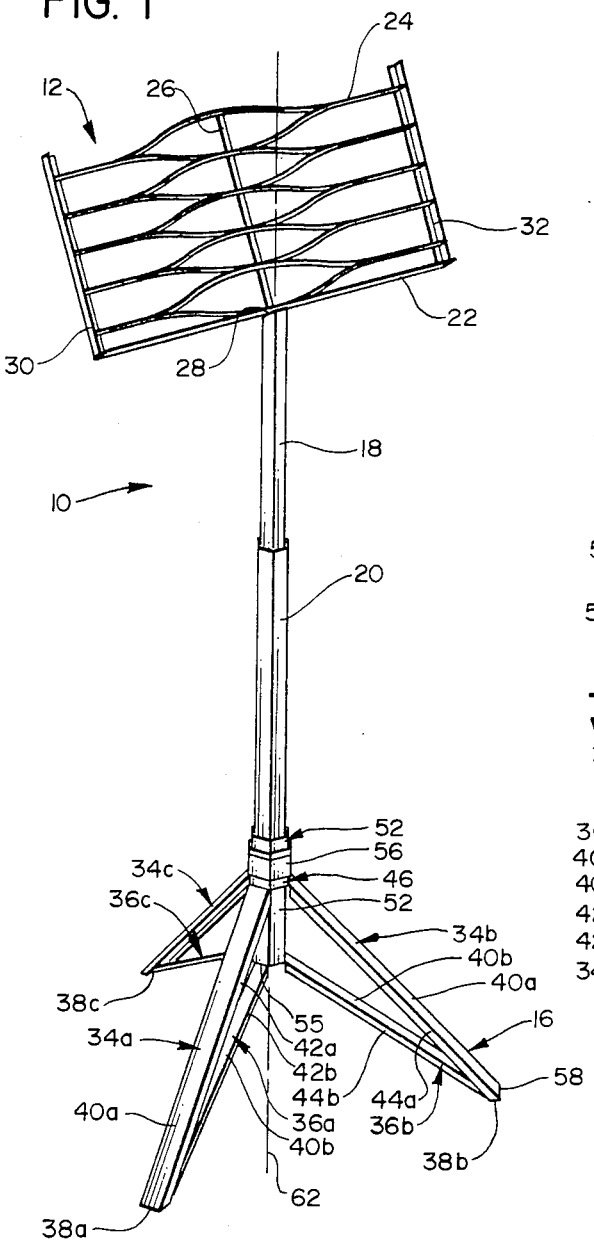
FIG. 1 is an isometric view illustrating the supporting stand of the present invention in its expanded open position.

As shown in FIG. 1, there is a folding music stand, generally designated 10, which comprises a foldable music sheet rack member 12, at least one main tubular support member 14, and three leg members 16 arranged in tripodal relationship to one another. The main tubular support members 18 and 20 are arranged in telescopic relationship, with the members being biased against one another in any conventional manner (such as an O-ring). There may be any number of support members 14 which are necessary to raise the music sheet rack 12 to the desired height from the floor surface and as shown herein, the support members 14 have a hexagonal cross-sectional configuration and are in the form of two main support members 18 and 20.

The music sheet rack member 12 comprises a base support member 22 upon which the sheet music rests, and an expansible back support member 24 which is maintained in an expanded position by retaining member 26 which is pivotally mounted at 28 to the base support member 22. There are a pair of extension members 30 and 32 respectively which are pivotally mounted at the distal ends of the base member 22 such that they may be placed along the outer edge portions of back support member 24 in order to further support sheet music, or may be pivoted downwardly to serve as an extension of base support member 22 in order to support sheet music of greater width. The entire music sheet rack member 12 may be folded into a compact unit by releasing the retaining member 26, thereby allowing the back support member 24 to fold accordian-like adjacent the base support member 22, whereafter the retaining member 26 and extension members 30 and 32 are all pivoted adjacent the base support member 22 and back support member 24. A conventional clasp or latching device may be utilized to maintain the music sheet rack member in the folded position.

The leg structure 16 is arranged in tripodal configuration and comprises three leg members 34a, b and c and three corresponding adjacent bracing struts 36*a*, *b* and *c*. The corresponding leg members 34 and bracing struts 36 are hingedly affixed to one another at their lower or outer end portions 38. Each of the leg members 34, as illustrated, comprises ⅓ of a hexagon, with a flat side portion (or web) 40and two intermediate side portions (or flanges) 42*a* and 44*a* along each longitudinal edge portion of the flat side portion 40*a*. Likewise, each of the bracing structures 36 comprises ⅓ of a hexagon, with a flat side portion (or web) 40*b* and two intermediate side portions (or flanges) 42*b* and 44*b* along each longitudinal edge portion of the flat side portion 40*b*. The web portion 40 of leg members and bracing struts 34 and 36 comprises one side of the hexagonal cross-sectional configuration of a telescopic tubular member, and the flange portions 42 and 44 each comprise ½ of an adjacent side. Therefore, each flange portion 42 and 44 is arranged at approximately a 120° angle to its associated web portion 40 of each leg member 34 or bracing strut 36.

Figure 2:
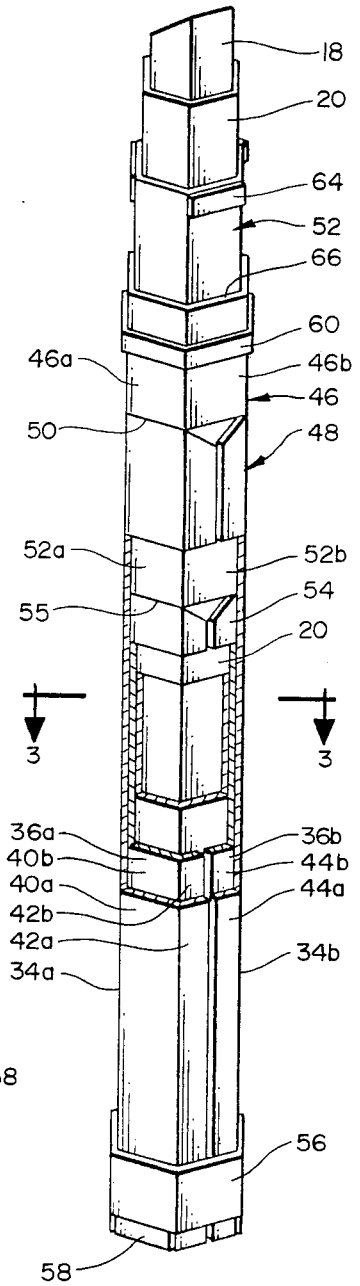
FIG. 2 is an isometric view illustrating a portion of the present invention in the collapsed position.

The leg members 34, when folded, comprise an outermost tubular enclosing member, and the bracing struts 36 when folded comprise an inner enclosing tubular structure, within which the main tubular support members 14 are retained. As shown in FIG. 2, the leg support structure is made up of an upper tubular leg portion 46, and a lower portion 48 which is comprised of the leg members 34a, b and c in a closed position. The upper tubular leg portion 46 has three flat side portions 46a and three inter mediate side portions 46*b*. The leg members 34 are hinge-mounted at 50 to the upper tubular leg portion 46 at the flat side portions 40*a* and 46*a*, such that they may be moved from the open position of FIG. 1 to the closed position of FIG. 2. In the closed position of FIG. 2, the longitudinal edges of flange portions 42 and 44 of adjacent leg members 34 abut one another to form the lower extension 48 of upper tubular leg portion 46 to complete the outermost tubular enclosing member.

Radially inwardly from the upper and lower portions 46 and 48 of the outermost tubular enclosing member is the inner tubular enclosing member which telescopes within the outermost tubular enclosing member. The inner enclosing member comprises an upper tubular brace portion 52 and a lower portion comprising the bracing struts 36*a*, *b* and *c*. The upper tubular brace portion 52 has three flat side portions 52*a* and intermediate side portions 52*b*. The bracing struts 36 are hinged at 55 to the upper tubular brace portion 52 at the flat side portions 40*b* and 52*a*, and form an inner hexagonal tube when in the closed position of FIG. 2 in the same manner as the leg members 34 form the outer hexagonal tubular enclosing member.

There is a collar member 56 which maintains the leg members 34 and bracing struts 36 in the closed position of FIG. 2 when placed about their lower or outermost ends. Stop means 58 are provided on the end of each leg strut 34 to maintain the collar member 56 in the position shown in FIG. 2.

The web portion 40*a* of each leg member 34 may be considered as a hinge mounted downward extension of its related flat side portion 46*a*, and each of the flange portions 42*a* and 44*a* may be considered as one-half of a downward extension of a lateral portion of a related intermediate side portion 46*b*. Likewise, the web portion 40*b* of each bracing strut 36 may be considered as a hinge mounted downward extension of its related flat side portion 52*a*, and each of the flange portions 42*b* and 44*b* may be considered as one-half of a downward extension of a lateral portion of a related intermediate side portion 52*b*.

Figure 3:
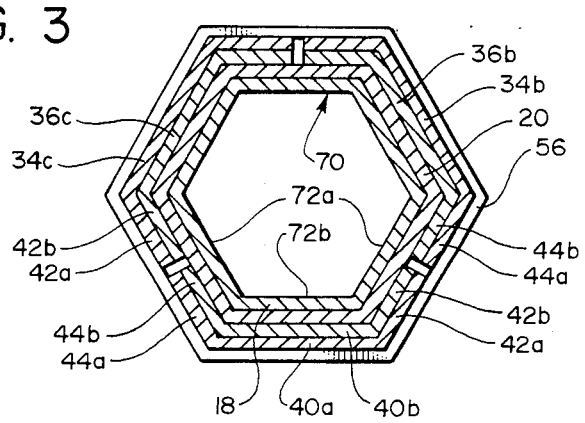
FIG. 3 is a transverse sectional view taken along line 3—3 of FIG. 2.

As shown in FIG. 3, the main support members 18 and 20 have a cross-sectional configuration similar to that of the upper tubular leg portion or the upper tubular brace portion, and as shown herein has a hexagonal cross-sectional configuration with six sides 70. In terms of function, the six sides 70 can be considered as being made up of three flat side sections 72*a* and three intermediate side sections 72*b* which are spaced alternately with the side sections 72*a* and connect the flat side sections 72*a* to one another. The flat side sections 72*a* correspond to the web portions 40 of the leg members 34 and bracing struts 36, and the intermediate side portions 72*b* correspond to adjacent flange portions 42 and 44 of leg members 34 and bracing struts 36. Because the main support sections, the leg structures and brace structures all interfit in slideable telescopic relationship, they all have the same general cross-sectional configuration.

In order to expand the leg members 34 and bracing struts 36 to the open position of FIG. 1, the collar member 56 is moved upwardly to the tubular leg portion 46 of the outer tubular enclosing member where it abuts stop means 60. With the collar member 56 above the hinge axis 50, the leg members 34 and bracing struts 36 are free to swing radially outwardly about the hinge axis 50. By moving the tubular leg portion 46 upwardly about the upper tubular brace portion 52 of the inner tubular enclosing member, the upper portion of the leg members 34 are pulled upwardly. Because the bracing struts 36 are affixed to the upper tubular brace portion 52 at 55, and may not move upwardly as the tubular leg portion 46 moves upwardly, the leg members 34 are separated from the bracing struts 36 as the tubular leg portion 46 moves upwardly. The lower outermost end portion of each leg member 34 and bracing strut 36 is pulled radially outwardly away from the longitudinal axis 62 as the tubular leg portion 46 moves upwardly about the tubular brace portion 52.

The upward limit of travel of the tubular leg portion 46, and therefore the amount of radially outwardly directed movement of the leg members and bracing struts is determined by the stop means 64 on the tubular brace portion 52. When the upper edge portion of the collar member 56 abuts against the stop means 64, the leg members 34 and bracing struts 36 are prevented from further outward movement. To place the leg structures in the closed position one need only move the collar member 56 downwardly, which, as the collar member 56 contacts the upper portion of each leg member 34 and forces it downwardly, forces the leg members 34 and bracing struts 36 radially inwardly toward the longitudinal axis and the closed position of FIG. 2.

Figure 4:
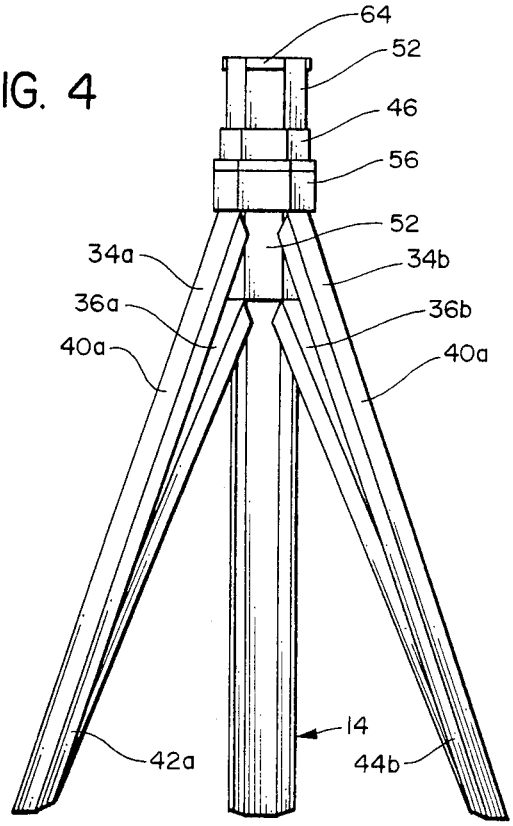
FIG. 4 is an isometric view of the present invention, showing the legs partially extended.

As shown in FIG. 4, with the main support members 14 telescoped downwardly, if the collar member 56 is moved downwardly about the leg members 34, a compact tubular member will be formed which allows easy storage or transport. The music sheet rack member 12 may be folded as described above, and secured within the main support members 14 in any conventional manner.

A second embodiment of the present invention is illustrated in FIGS. 5 through 13. Components of this second embodiment which are similar to components of the first embodiment will be given like numerical designations with a prime (') designation distinguishing those of the second embodiment.

The music stand 10' comprises the basic components of the sheet rack member or platform means 12', the tubular support member 14' (which is made up of the two telescoping members 18' and 20'), and the three leg members 16'.

One of the modifications of this second embodiment is the releasable retaining means utilized to yieldingly hold the two telescoping support members 18' and 20' and the upper tubular brace portion 52' in their stowed and open positions. To accomplish this, the upper circumferential portion 100 of the tubular brace portion 52' has edge corner portions 102 thereof formed with laterally extending through openings 104. (See FIGS. 6 and 8.) A flexible retaining ring 106 (desirably in the form of an elastomeric "O" ring) is positioned around the circumferential portion 100 in a moderately stretched condition, so that the flexible ring 106 is in tension as it is yieldingly draws itself into the openings 104.

Figure 5:
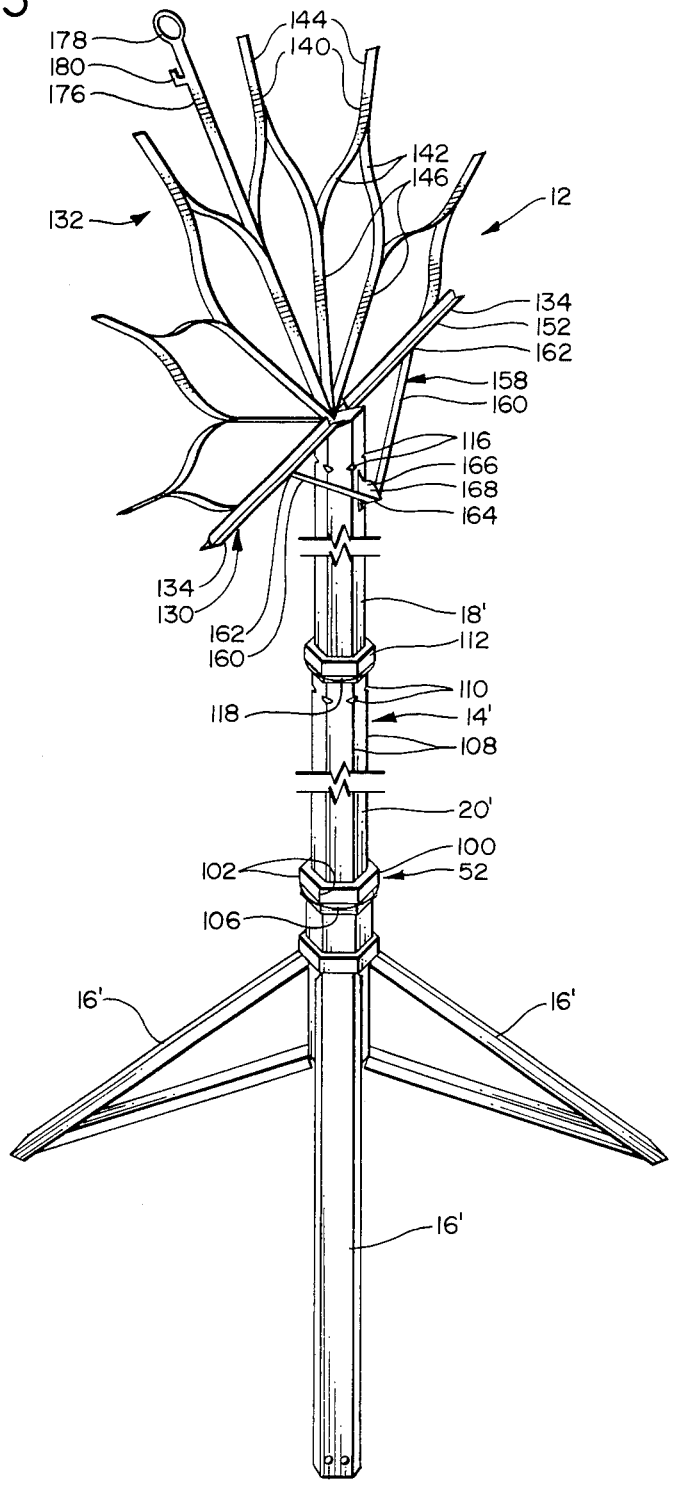
FIG. 5 is an isometric view illustrating a second embodiment of the music stand of the present invention in its expanded operating position.

The outer edge corner portions 108 of the outer telescoping member 20 are formed at the upper and lower ends thereof with small laterally extending recesses 110 arranged in a configuration to match the slots or openings 104 in the upper circumferential edge portion 100 of the brace portion 52'. (Only the lower set of recesses 110 are shown in FIG. 5.) Thus, when the tubular support portion 20' is moved downwardly in telescoping fashion within the tubular brace portion 52', in the stowed position, the upper set of recesses 110 are aligned with the openings 104, so that the resilient retaining ring 106 moves into the upper set of recesses 110 so as to yieldingly hold the support section 20' in the collapsed position relative to the tubular brace portion 52'. Likewise, when the tubular support position 20' is pulled upwardly to the extended position, the resilient ring 106 fits in the lower set of recesses 110 to yieldingly hold the member 20' in the extended position.

In like manner, the upper edge portion of the outer tubular support member 20' is formed with an expanded upper end section 112 having at the corners thereof slots 114 formed in the same manner as the slots or openings 104 of the tubular brace portion 52'. In like manner, the upper and lower end portions of the inner telescoping member 18' is formed with the edge recesses 116 configured similarly to the recesses 110. (Only the upper set of recesses 116 is shown in FIG. 5.) There is a second retaining ring 118 which fits in the slots 114. When the inner support member 18' is moved downwardly to the stowed position within the outer support member 20', the second retaining ring 118 comes into engagement with the second set of recesses 116. When it is desired to move the support members 18' and 20' upwardly from the stowed position to their expanded position, the two retaining rings 106 and 118 are sufficiently yielding to permit this action, so that these retaining rings 106 and 118 move out of their related recesses 110 and 116. The same is true when the support members 18' and 20' are in their extended positions and are moved to the stowed position.

The music sheet rack member or platform means 12' comprises a base portion 130 and a back support portion 132. The base portion 130 comprises elongate first and second base sections 134 pivotally mounted at 136 to a central base section 138. This pivot or hinged mounting of the base sections 134 can be accomplished, for example, by forming the music sheet rack member 12' of a molded plastic which is sufficiently elastic so that the hinge connections 136 can be formed as "living hinges".

The back support portion 132 is formed of a plurality of upstanding support sections 140 which extend radially outwardly from the lower central location of the base middle section 134. Each support section 140 comprises a pair of moderately resilient radially outwardly extending arms 142 which are integrally joined to one another at outer ends thereof in parallel relationship at 144. The inner end of each arm 142 is integrally joined at 146 to an adjacent inner end of an adjacent support section 140. The two outermost support sections 140 have their outer arms extending radially inwardly to join to the related base sections 134. The inner ends of each integrally joined adjacent pair of arms 142 are joined by flexible connections 147.

Each base section 134 is formed with upper and lower vertically extending reinforcing flanges 148 and 150. Also, each base section 134 comprises an elongate forwardly extending support flange 152. At the forward edge of each support flange (see FIG. 6), there is a second auxiliary flange 154 hinge mounted at its inner edge 156 to the forward edge of its related flange 152. Thus, as can be seen in FIG. 6, the auxiliary flange 154 can be swung from a collapsed position where it overlies the support flange 152 (shown in broken lines in FIG. 6) to the expanded position shown in the full lines of FIG. 2.

There is a collapsible positioning linkage 158, formed as two links 160 pivotally connected at laterally outward locations at 162 to the two auxiliary flanges 154. The inner ends of the two links 160 are hingedly connected to one another at 164. When the music sheet rack member 12' is in the collapsed position (see FIG. 11), these two links 160 are positioned more closely to one another and form a relatively small angle. When the sheet rack member 12' is expanded to the position of FIG. 10, these links 160 are at approximately a right angle to one another.

Figure 6:
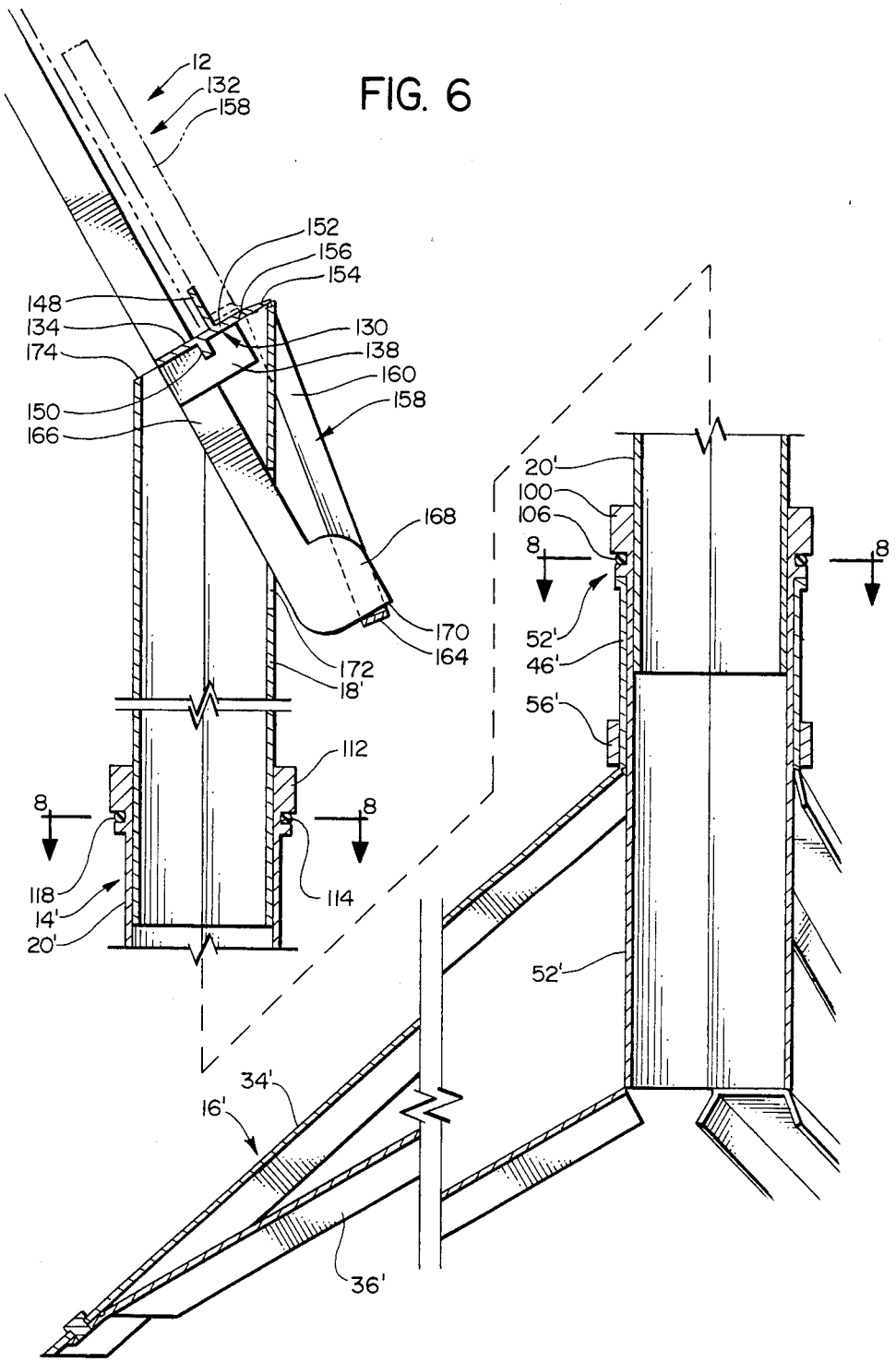
FIG. 6 is a vertical sectional view taken through the vertical center axis of the main support member of the music stand in the second embodiment, with the lower support section being shown as separated from the upper support section at which the music sheet rack member of the second embodiment is mounted.
Figure 10:
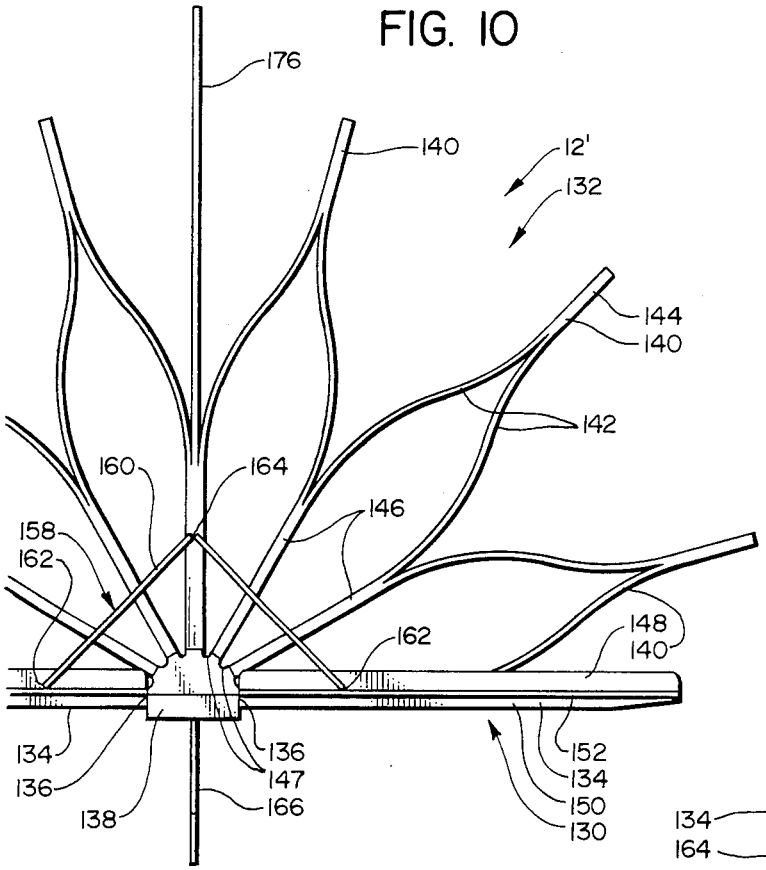
FIG. 10 is a front elevational view showing the music sheet rack member of the second embodiment in its expanded position.
Figure 11:
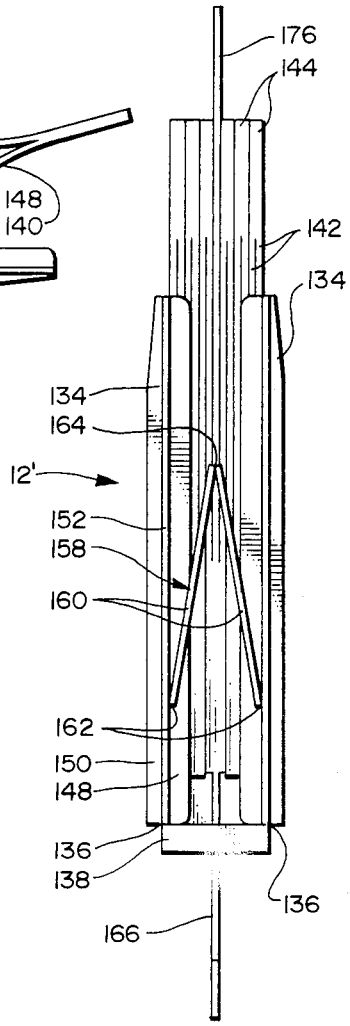
FIG. 11 is a view similar to FIG. 10, but showing the music sheet rack member of the second embodiment in its collapsed position.

Fixedly connected to an extending downwardly from the central base section 138 is a mounting strut 166 (See FIG. 6). This mounting strut 166 has at is lower end a protruding portion 168 which has a lower retaining edge 170. This strut 166 is arranged so that it can fit into the upper open end of the upper telescoping support member 18', with the lower protruding portion 168 extending through a side opening 172 formed in a forward surface of the upper telescoping member 18'. The upper edge portion 174 of the upper support section 18' is formed at a moderate downward and rearward slant, relative to a horizontal plane, so that the edge portion 174 supports the base portion 130 of the music sheet rack member 12' at a moderate upward and rearward slant from the vertical. At such a slant, the strut 166 is positioned so that the lower protruding portion 168 fits through the side opening 172 so as to retain the music sheet rack member 12' in its mounting position, as illustrated in FIGS. 5 and 6.

After the music sheet rack member 12' is mounted to the upper support section 12' as illustrated in FIGS. 5 and 6, the two auxiliary flanges 154 are moved about their hinged connections 156 180 degrees to the forwardly extending support position, with this movement bringing the positioning linkage 158 from an up position (see FIG. 10) to its downwardly extending position, as shown in full lines of FIGS. 5 and 6. The connecting edges 164 of the two links 160 fit just beneath the lower retaining edge 170 of the protruding portion 168, and this prevents upward movement of the two base sections 134. The connections of the outer arm portions 144 and the inner arm portions 146 are such that these arms 142 resiliently urge the two base sections 134 toward the collapsed position. The positioning of the linkage 158 in its downward retaining position maintains the sheet rack member 12' in the expanded position by preventing these base sections 134 from moving toward one another to the stowed position.

The back support section 132 is provided with a central carrying arm 176 which extends radially outwardly from the lower middle pivot location and has at its upper outer end a carrying ring 178. It is to be understood, of course, that some other type of carrying handle or device could be substituted for the ring 178. This arm 176 has just below its carrying ring 178 a laterally extending retaining finger 180 which is arranged to fit through a retaining opening 182 in the back side of the upper support section 18'. Thus, with the music rack member 12' positioned in its collapsed position within the telescoping support member 18', this finger 180 can engage the opening 182 so that the entire music stand (in its collapsed stowed position) can be carried by means of the ring 178.

To describe the operation of the music sheet rack member 12', in the collapsed position, the two auxiliary flanges 154 are rotated upwardly to the collapsed position where they overlie the support flanges 152. In that position, the sheet rack member 12 will (because of the resiliency of the structure of the arms 142) move to the collapsed position (i.e., from the position of FIG. 10 to the position of FIG. 11). In this collapsed position, the entire music sheet rack member 12' can be placed within the telescoping support sections 18' and 20'. When it is desired to place the sheet rack member 12' in its expanded operating position, the sheet rack member 12' is removed from within the telescoping sections 18' and 20' and expanded to the positions shown in FIGS. 5 and 6. In such a position, the mounting strut 168 is first positioned in the upper end of the support member 18' and the positioning linkage 158 is swung downwardly to the open position where it engages the lower edge of the protruding portion 168 of the strut 166.

An alternative form of the sheet rack member is illustrated in FIGS. 12 and 13, and is designated 12''. This sheet rack member 12'' is generally the same as the previously described sheet rack member 12' of the second embodiment, except that there are provided radially extending arms 186 which are connected at outer ends thereof by means of linkages 188 having two linkage arms 190 pivotally connected to one another at 192, and hinge mounted to the outer ends of the arms 190, as at 194. These arms 190 can be moved to the collapsed position, as shown in FIG. 13, and the expanded position is shown in FIG. 12.

It is to be understood that various modifications could be made without departing from the spirit of the present invention.

What is claimed is:

1. A support stand apparatus adapted to support a platform such as a music holding platform, and to be collapsed into a compact unit for storage or transport, said apparatus having a longitudinal axis and comprising:

a. at least one elongate main support member, having a generally uniform cross-sectional configuration made up of a plurality of first flat side portions spaced from one another about a circumference of said main support member, and a plurality of first intermediate side portions positioned about said circumference intermittently between said flat portions and connecting said flat side portions to one another, b. a brace support structure positioned circumjacent said main support member and comprising 1. an upper tubular brace section having a cross-sectional configuration corresponding to that of said main support member and comprising second flat side portions overlying said first flat side portions and second intermediate side portion overlying said first intermediate side portions, 2. a lower bracing section made up of a plurality of bracing struts, each strut comprising a bracing web portion shaped as a downward extension of a related said second flat side portion and a pair of lateral flange portions shaped as downward extensions of lateral portions of related second bracing intermediate side portion, c. a leg support structure positioned circumjacent said brace support structure and comprising:

1. an upper tubular leg section having a cross-sectional configuration corresponding to those of said main support member and said brace support structure, said upper leg section comprising third flat side portions and third intermediate side portions overlying said second intermediate side portions, 2. a lower leg section made up of a plurality of leg members, each leg member comprising a leg web portion made as a downward extension of a related said third flat side portion and a pair of lateral leg flange portions shaped as downward extensions of lateral portions of related said third intermediate side portion.

d. said bracing struts having lower ends thereof connected to lower portions of said leg members, e. said bracing support structure and said leg support structure having a first closed position wherein said bracing struts lie against said main support member and said leg members lie against said bracing struts, said bracing struts and said leg members having a second open support position, wherein said upper tubular leg section is moved upwardly along said upper tubular bracing section with said leg members extending radially outwardly from said upper tubular leg section and said bracing struts extending outwardly to provide bracing support for said leg members.

2. The apparatus as recited in claim 1, wherein said lateral flange portions of said bracing strut are arranged at approximately a 120° angle to said bracing web portion, and said lateral leg flange portions are arranged at approximately a 120° angle to said leg web portions, and said first intermediate side portions are arranged at a 120° angle to said first flat side portions.

3. The apparatus as recited in claim 2, wherein said brace support structure comprises three lower bracing strut members, and said leg support structure comprises three leg members, such that when said bracing support structure and said leg support structure is in the first closed position, said bracing support structure and said leg support structure are arranged in a generally hexagonal cross-sectional configuration.

4. The apparatus as recited in claim 1, wherein each of said bracing struts comprises an upper portion and a lower portion, the upper portion being hingedly affixed to said upper tubular section at the location of said second flat side portions and said bracing web portion.

5. The apparatus as recited in claim 1, each of said leg members comprises an upper portion and a lower portion, the upper portion being hingedly affixed to said upper tubular leg section at the location of said third flat side portions and said leg web portion.

6. The apparatus as recited in claim 1, wherein said upper tubular leg section and said upper tubular brace section are provided in telescoping relationship such that when said bracing support structure and said leg support structure is moved from the first closed position to the second open position, said upper tubular leg section is moved upwardly about said upper tubular brace section, whereby said upper portion of each of said leg members is moved upwardly relative to the upper portion of each of said corresponding bracing struts.

7. The apparatus as recited in claim 6, wherein said upper tubular brace section comprises stop means at an upper portion thereof defining an upper limit of travel of said upper tubular leg section and a maximum radially outward movement of said leg members and said bracing struts.

8. The apparatus as recited in claim 1, wherein said leg support structure further comprises a retaining collar member adapted to overfit and maintain the lower portion of each of said leg members in said first closed position, position, said retaining collar member being moveable upwardly about said upper tubular leg section when said lower leg sections are moved to said second open position.

9. The apparatus as recited in claim 8, wherein said upper tubular leg section comprises stop means at an upper end thereof defining an upper limit of travel of said retaining collar member, and a lower portion of each of said leg members compris retaining collar member, and a lower portion of each of said leg members comprises stop means defining a lower limit of travel of said retaining collar member.

10. The apparatus as recited in claim 1, wherein said main support member comprises a plurality of telescoping sections adapted to slideably fit within and frictionally engage one another.

11. The apparatus as recited in claim 10, wherein each of said main support members has a generally hexagonal cross-sectional configuration.

12. The apparatus as recited in claim 1, wherein said music holding platform has a first closed position and a second open position, said music holding platform being adapted to fit within said main support member when in said first closed position.

13. The apparatus as recited in claim 1, wherein:

a. the upper tubular brace section of the brace support structure is mounted in telescoping relationship with the main support member, and each of said main support members and said upper tubular brace section has at least one edge corner portion, the edge corner portion of the upper tubular brace section having a through opening, b. a retaining ring member extending around said upper tubular brace section and positioned in said through opening so as to engage the edge corner portion of the main support member so as to yieldingly resist relative telescoping motion between said upper tubular brace section and said main support member.

14. The apparatus as recited in claim 13, wherein the edge corner portion of the main support member has a recess to receive said retaining ring member, with said retaining ring member yieldingly resisting movement in and out of said recess.

15. The apparatus as recited in claim 14, wherein the upper tubular brace section has a plurality of edge portions, each having a related through opening to receive said retaining ring member, and said main support member has a plurality of said recesses to receive in yielding engagement said retaining ring member.

16. The apparatus as recited in claim 15, wherein said retaining ring member is made of an elastomeric material which yieldingly engages said recesses.

17. The apparatus as recited in claim 1, wherein a. said main support member comprises inner and outer main support sections mounted in telescoping relationship relative to one another, each of said inner and outer main support sections having at least one corner portion, the corner portion of the outer main support section being formed with a through opening, b. a retaining ring member extending around said outer main support section and positioned in said through opening to engage said inner telescoping section so as to yieldingly resist relative telescoping movement between the inner and outer main support sections.

18. The apparatus as recited in claim 17, wherein the edge corner portion of the inner telescoping section has a recess to receive the retaining ring member.

19. The apparatus as recited in claim 18, wherein the outer main support section has a plurality of edge corner portions, each having a through opening to receive said ring member, and the inner main support section has a plurality of recesses to receive said retaining ring member in yielding engagement.

20. The apparatus as recited in claim 19, wherein said retaining ring member is made of an elastomeric material which yieldingly engages said recesses.

21. The apparatus as recited in claim 1, wherein there is a support platform adapted to be mounted to said main support member, said platform comprising:

a. a base portion comprising first and second base sections pivotally mounted at a lower middle pivot location for movement between an expanded support position where the sections extend laterally outwardly from one another, and a stowed position where the base sections extend upwardly adjacent one another, b. an upstanding back support portion comprising a plurality of support sections extending radially outwardly from said pivot location, each of said support sections having inner end portions movable toward and away from one another and connecting to inner end portions of adjacent support sections, each of said support sections having outer end portions which connect to one another, the inner end portions interconnecting with said base sections in a manner that when said base sections are moved to the expanded support position, the inner ends of the support sections move away from one another to an expanded support position, and when said base sections are moved toward one another, the inner end portions of the support sections move toward one another to a stowed position.

22. The apparatus as recited in claim 21, wherein each of said first and second base sections has a lengthwise extending flange portion extending radially outwardly from said pivot location, each flange portion being pivotally mounted to its related base section about a lengthwise pivot axis so as to be movable away from its related base section to an expanded position, said flange portions being interconnected by a bracing linkage which is movable with said flange portions to a retaining position to hold said base secitons in said expanded support position.

23. The apparatus as recited in claim 22, wherein said support portion of the platform has at an upper end thereof carrying ring means, said platform being characterized in that in the stowed position, said platform can be inserted within said main support member and said support stand apparatus can be carried by said ring means.

24. The apparatus as recited in claim 23, wherein said platform has a mounting member extending downwardly from said base portion and configured to be inserted in an upper end of said main support member, said mounting member having interconnecting means by which said mounting member can be connected to said main support member in a manner that said platform can be mounted to said main support member in its expanded support position.

25. The apparatus as recited in claim 24, wherein said mounting member and said braicng linkage are arranged so that the bracing linkage in said retaining position extends downwardly to engage said mounting member to prevent upward movement of said base sections.

26. The apparatus as recited in claim 1, wherein there is a support platform adapted to be mounted to said main support member, said platform comprising:

a. a base portion comprising first and second base sections pivotally mounted at a lower middle pivot location for movement between an expanded support position where the sections extend laterally outwardly from one another, and a stowed position where the base sections extend upwardly adjacent one another, b. an upstanding back support portion connected to said base sections and movable therewith between the expanded and stowed positions;

c. each of said first and second base sections having a lengthwise extending flange portion extending radially outwardly from said pivot location, each flange portion being pivotally mounted to its related base section about a lengthwise pivot axis so as to be movable away from its related base section to an expanded position, said flange portions being interconnected by a bracing linkage which is movable with said flange portions to a retaining position to hold said base sections in said expanded support position.

27. The apparatus as recited in claim 26, wherein said back support portion of the platform has at an upper end thereof carrying ring means, said platform being characterized in that in the stowed position, said platform can be inserted within said main support member and said support stand apparatus can be carried by said ring means.

28. The apparatus as recited in claim 27, wherein said platform has a mounting member extending downwardly from said base portion and configured to be inserted in an upper end of said main support member, said mounting member having interconnecting means by which said mounting member can be connected to said main support member in a manner that said platform can be mounted to said main support member in its expanded support position.

29. The apparatus as recited in claim 28, wherein said mounting member and said bracing linkage are arranged so that the bracing linkage in said retaining position extends downwardly to engage said mounting member to prevent upward movement of said base sections.

30. The apparatus as recited in claim 1, wherein there is a support platform adapted to be mounted to said main support member, said platform comprising:

a. a base portion comprising first and second base sections pivotally mounted at a lower middle pivot location for movement between an expanded support position where the sections extend laterally outwardly from one another, and a stowed position where the base sections extend upwardly adjacent one another, b. an upstanding back support portion connected to said base sections and movable therewith between the expanded and stowed positions, c. a bracing linkage which is movable to a retaining position to hold said base sections in said expanded support position, d. said platform having a mounting member extending downwardly from said base portion and configured to be inserted in an upper end of said main support member, said mounting member having interconnecting means by which said mounting member can be connected to said main support member in a manner that said platform can be mounted to said main support member in its expanded support position, e. said mounting member and said bracing linkage being arranged so that the bracing linkage in said retaining position extends downwardly to engage said mounting member to prevent upward movement of said base sections.

31. The apparatus as recited in claim 1, wherein there is a support platform adapted to be mounted to said main support member, said platform comprising:

a. a base portion comprising first and second base sections pivotally mounted at a lower middle pivot location for movement between an expanded support position where the sections extend laterally outwardly from one another, and a stowed position where the base sections extend upwardly adjacent one another, b. an upstanding back support portion connected to said base sections and movable therewith between the expanded and stowed positions, c. said platform having a mounting member extending downwardly from said base portion and configured to be inserted in an upper end of said main support member, said mounting member having interconnecting means by which said mounting member can be connected to said main support member in a manner that said platform can be mounted to said main support member in its expanded support position.

32. The apparatus as recited in claim 31, wherein there is a bracing linkage which is mounted to said base portion and is movable to a retaining position to hold said base sections in said expanded position, said mounting member and said bracing linkage being arranged so that the bracing linkage in said retaining position extends downwardly to engage said mounting member to prevent upward movement of said base sections.

33. The apparatus as recited in claim 1, wherein there is a support platform adapted to be mounted to said main support member, said platform comprising:

a. a base portion arranged to be positioned in either an expanded support position where the back portion extends laterally, and a stowed position, b. an upstanding back support portion connected to said base portion and movable between said support position and said stowed position;

c. said platform having at an upper end thereof carrying ring means, said platform being characterized in that in the stowed position, said platform can be inserted within said main support member and said support stand apparatus can be carried by said ring means.

34. A support platform adapted to be mounted to a main support member, said platform comprising:

a. a base portion comprising first and second base sections pivotally mounted at a lower middle pivot location for movement between an expanded support position where the sections extend laterally outwardly from one another, and a stowed position where the base sections extend upwardly adjacent one another, b. an upstanding back support portion comprising a plurality of support sections extending radially outwardly from said pivot location, each of said support sections having inner end portions movable toward and away from one another and connecting to inner end portions of adjacent support sections, each of said support sections having outer end portions which connect to one antoher, the inner end portions interconnecting with said base sections in a manner that when said base sections are moved to the expanded support position, the inner ends of the support sections move away from one another to an expanded support position, and when said base sections are moved toward one another, the inner end portions of the support sections move toward one another to a stowed position.

35. The apparatus as recited in claim 34, wherein each of said first and second base sections has a lengthwise extending flange portion extending radially outwardly from said pivot location, each flange portion being pivotally mounted to its related base section about a lengthwise pivot axis so as to be movable away from its related base section to an expanded position, said flange portions being interconnected by a bracing linkage which is movable with said flange portions to a retaining position to hold said base sections in said expanded support position.

36. The apparatus as recited in claim 35, wherein said platform has a mounting member extending downwardly from said base portion and configured to be inserted in an upper end of said main support member, said mounting member having interconnecting means by which said mounting member can be connected to said main support member in a manner that said platform can be mounted to said main support member in its expanded support position.

37. The apparatus as recited in claim 36, wherein said mounting member and said bracing linkage are arranged so that the bracing linkage in said retaining position extends downwardly to engage said mounting member to prevent upward movement of said base sections.

38. A support platform adapted to be mounted to a main support member, said platform comprising:

a. a base portion comprising first and second base sections pivotally mounted at a lower middle pivot location for movement between an expanded support position where the sections extend laterally outwardly from one another, and a stowed position where the base sections extend upwardly adjacent one another, b. an upstanding back support portion connected to said base sections and movable therewith between the expanded and stowed position;

c. a bracing linkage which is movable with said brace portions to a retaining position to hold said base sections in said expanded support position;

d. said platform having a mounting member extending downwardly from said base portion and configured to be inserted in an upper end of said main support member, said mounting member having interconnecting means by which said mounting member can be connected to said main support member in a manner that said platform can be mounted to said main support member in its expanded support position;

e. said mounting member and said bracing linkage being arranged so that the bracing linkage in said retaining position extends downwardly to engage said mounting member to prevent upward movement of said base sections.

* * * * *